US010348047B2

(12) United States Patent
Cutsforth et al.

(10) Patent No.: US 10,348,047 B2
(45) Date of Patent: Jul. 9, 2019

(54) BRUSH WEAR AND VIBRATION MONITORING

(71) Applicant: CUTSFORTH, INC., Cohasset, MN (US)

(72) Inventors: Robert S. Cutsforth, Bellingham, WA (US); Dustin L. Cutsforth, Kansas City, MO (US)

(73) Assignee: Cutsforth, Inc., Bellingham, WA (US)

( * ) Notice: Subject to any disclaimer, the term of this patent is extended or adjusted under 35 U.S.C. 154(b) by 147 days.

(21) Appl. No.: 15/168,607

(22) Filed: May 31, 2016

(65) Prior Publication Data

US 2016/0352058 A1 Dec. 1, 2016

Related U.S. Application Data

(60) Provisional application No. 62/169,222, filed on Jun. 1, 2015.

(51) Int. Cl.
*H01R 39/58* (2006.01)
*H01R 39/38* (2006.01)

(52) U.S. Cl.
CPC ..... *H01R 39/58* (2013.01); *H01R 39/38* (2013.01)

(58) Field of Classification Search
CPC ..... H01R 39/38; H01R 39/381; H01R 39/58; H02K 11/00; H02K 11/20
See application file for complete search history.

(56) References Cited

U.S. PATENT DOCUMENTS

| | | | |
|---|---|---|---|
| 1,307,028 | A | 6/1919 | Sweet |
| 2,935,632 | A | 5/1960 | Schmitz, Jr. |
| 3,523,288 | A | 8/1970 | Thompson |
| 3,534,206 | A | 10/1970 | Carey |
| 3,641,379 | A | 2/1972 | Vick |
| 4,024,525 | A | 5/1977 | Baumgartner et al. |
| 4,058,804 | A | 11/1977 | Sawada et al. |
| 4,121,207 | A | 10/1978 | Jones |
| 4,172,988 | A | 10/1979 | Lowther |
| 4,272,695 | A | 6/1981 | Buchwald et al. |
| 4,316,186 | A | 2/1982 | Purdy et al. |

(Continued)

FOREIGN PATENT DOCUMENTS

| | | | |
|---|---|---|---|
| AU | 2008256639 | B2 | 2/2014 |
| CA | 2688007 | A1 | 12/2008 |
| CN | 1442683 | A | 9/2003 |
| DE | 3417711 | A1 | 11/1985 |
| DE | 19755232 | A1 | 6/1999 |

(Continued)

*Primary Examiner* — Tran N Nguyen

(74) *Attorney, Agent, or Firm* — Seager, Tufte & Wickhem LLP

(57) ABSTRACT

A brush holder assembly for use in an electrical generator having a moving conductive surface may include a brush holder, such as a brush box, that is configured to be removably mounted to a mounting element on the electrical generator. A carbon brush may be slidingly disposed with the brush holder and may be biased into sliding contact with the moving conductive surface. The brush holder assembly includes a handle that is moveable between an unlocked position in which the brush holder is removable from the mounting element and a locked position in which the brush holder is secured relative to the mounting element. A circuit board is disposed within the handle and includes a sensor that provides an indication of an occurrence of an anomalous and/or threshold condition of the carbon brush.

20 Claims, 9 Drawing Sheets

(56) References Cited

U.S. PATENT DOCUMENTS 4,329,611 A * 5/1982 Ohmstedt ..... H02K 9/28 310/227
4,329,683 A 5/1982 Kimberlin
4,333,095 A 6/1982 Silva
4,344,009 A 8/1982 Reynolds
4,344,072 A 8/1982 Harper, Jr.
4,348,608 A 9/1982 Michael
4,355,254 A * 10/1982 Oki ..... H01R 39/40 310/239
4,390,870 A 6/1983 Michael
4,400,638 A 8/1983 Albrecht et al.
4,420,705 A 12/1983 Kimberlin
4,488,078 A 12/1984 Orton
4,513,495 A 4/1985 Kimberlin
4,528,556 A 7/1985 Maddox
4,528,557 A 7/1985 Braun
4,536,670 A 8/1985 Mayer
4,542,374 A 9/1985 Kollmannsberger et al.
4,577,151 A 3/1986 Tanisaka et al.
4,636,778 A 1/1987 Corkran et al.
4,646,001 A 2/1987 Baldwin et al.
4,652,783 A 3/1987 Cheesmore et al.
4,723,084 A 2/1988 Reynolds
4,739,208 A 4/1988 Kimberlin
4,743,787 A 5/1988 Bunner et al.
4,761,594 A 8/1988 Rodi et al.
4,918,348 A 4/1990 Fitzsimmons et al.
4,950,933 A * 8/1990 Pipkin ..... H01R 39/58 310/219
4,977,345 A 12/1990 Toperzer
5,229,817 A 7/1993 Lange et al.
5,256,925 A 10/1993 Cutsforth
5,327,184 A 7/1994 Nomura et al.
5,387,831 A 2/1995 Yang
5,397,952 A 3/1995 Decker et al.
5,463,264 A 10/1995 Koenitzer
5,488,261 A 1/1996 Swoboda et al.
5,509,625 A 4/1996 Oullette et al.
5,621,262 A 4/1997 Han
5,731,650 A * 3/1998 Scheucher ..... H01R 39/58 310/242
5,739,619 A 4/1998 Thornley
5,753,992 A 5/1998 Avitable et al.
5,753,995 A 5/1998 Ogino
5,870,026 A 2/1999 Challenger
6,034,531 A 3/2000 Senglat et al.
6,067,159 A 5/2000 Discenzo et al.
6,111,643 A 8/2000 Discenzo et al.
6,255,955 B1 7/2001 Blaettner
6,359,690 B1 3/2002 Discenzo et al.
6,495,940 B2 12/2002 Kliman et al.
6,552,467 B1 4/2003 Suriano et al.
6,580,511 B1 6/2003 Discenzo
6,598,597 B1 7/2003 Marocco et al.
6,731,042 B1 5/2004 Bank et al.
6,933,650 B2 8/2005 Wang
6,960,922 B2 11/2005 Klaar
6,966,754 B2 11/2005 Wobben
6,972,681 B2 12/2005 Matsuoka et al.
7,005,964 B2 2/2006 Edmonson et al.
7,010,959 B2 3/2006 Dingfelder et al.
7,034,430 B2 4/2006 Custforth et al.
7,045,929 B2 5/2006 Yu
7,049,532 B2 5/2006 Kanazawa et al.
7,122,935 B2 10/2006 Cutsforth et al.
7,141,906 B2 11/2006 Cutsforth et al.
7,218,028 B2 5/2007 Annis et al.
7,358,640 B2 4/2008 Itou et al.
7,365,470 B1 * 4/2008 Eger ..... H01R 39/40 310/239
7,417,354 B2 8/2008 Cutsforth et al.
7,485,882 B2 2/2009 Zombo et al.
7,545,072 B2 6/2009 Cutsforth
7,551,288 B1 6/2009 Discenzo
7,564,160 B2 7/2009 Cutsforth et al.
7,705,744 B2 4/2010 Cutsforth
7,768,174 B2 8/2010 Cutsforth et al.
7,816,834 B2 10/2010 Cutsforth
7,880,362 B2 2/2011 Cutsforth et al.
7,880,363 B2 2/2011 Cutsforth et al.
7,916,038 B2 3/2011 Cutsforth
7,960,892 B2 6/2011 Cutsforth
7,990,018 B2 8/2011 Cutsforth et al.
7,994,683 B2 8/2011 Cutsforth et al.
8,047,083 B2 11/2011 Puzio et al.
8,054,190 B2 11/2011 Hobelsberger
8,084,704 B2 12/2011 Mark et al.
8,120,503 B2 2/2012 Mark et al.
8,134,472 B2 3/2012 Cutsforth
8,159,396 B2 4/2012 Folden et al.
8,165,552 B2 4/2012 Rofougaran et al.
8,179,014 B2 5/2012 Cutsforth et al.
8,618,943 B2 12/2013 Cutsforth et al.
8,825,800 B2 9/2014 Cutsforth
9,252,643 B2 * 2/2016 Cutsforth ..... H01R 39/58
9,793,670 B2 * 10/2017 Steinbach ..... H01R 39/385
2001/0043022 A1 11/2001 Narushima et al.
2003/0011388 A1 1/2003 Klaar
2005/0116475 A1 6/2005 Hibi et al.
2006/0021775 A1 2/2006 Duesselberg et al.
2007/0273165 A1 11/2007 Beck et al.
2008/0101895 A1 5/2008 Holcomb et al.
2008/0291273 A1 11/2008 Cutsforth et al.
2009/0096315 A1 4/2009 Mantle
2009/0153089 A1 6/2009 Hobelsberger
2009/0267782 A1 10/2009 Mark et al.
2011/0210837 A1 9/2011 Jin
2012/0169176 A1 7/2012 Toledo et al.
2012/0206010 A1 * 8/2012 Kuban ..... H01R 39/40 310/242
2012/0248929 A1 10/2012 Fish et al.
2013/0218514 A1 8/2013 Schieke et al.
2014/0077960 A1 3/2014 Cutsforth
2014/0125206 A1 5/2014 Fish et al.
2014/0265675 A1 9/2014 Cutsforth

FOREIGN PATENT DOCUMENTS

DE 202006003418 U1 5/2006
DE 102005062073 A1 7/2007
DE 102012102726 A1 10/2012
EP 0099158 A1 1/1984
EP 0920092 A2 6/1999
EP 1090702 A2 4/2001
EP 1271716 A1 1/2003
EP 1439042 A2 7/2004
EP 1441422 A2 7/2004
EP 1801938 A2 6/2007
EP 2151024 B1 8/2013
EP 2642642 A2 9/2013
GB 2172445 A 9/1986
JP 56101360 A 8/1981
JP 57138846 A * 8/1982 ..... H01R 39/58
JP 60039337 A 3/1985
JP 62037039 A * 2/1987
JP 01321845 A 12/1989
JP 580163 U 10/1993
JP 08054226 A 2/1996
JP 2009268301 A * 11/2009
JP 201390425 A 5/2013
JP 2013174279 A 9/2013
JP 2016512679 A 4/2016
WO 0219698 A2 3/2002
WO 03052902 A1 6/2003
WO 2008148058 A1 12/2008
WO 2008148060 A2 12/2008
WO 2008148060 A3 5/2009
WO 2012119832 A1 9/2012
WO 2012123402 A1 9/2012
WO 2014150190 A1 9/2014

* cited by examiner

BRUSH WEAR AND VIBRATION MONITORING

CROSS-REFERENCE TO RELATED APPLICATIONS

This application claims priority under 35 U.S.C. § 119(e) to U.S. Provisional Application No. 62/169,222, filed Jun. 1, 2015, the entire disclosure of which is herein incorporated by reference.

TECHNICAL FIELD

The disclosure generally relates to monitoring systems for monitoring one or more components of an electrical device, such as an electrical generator. More specifically, the disclosure relates to monitoring apparatus, assemblies, systems and methods of monitoring one or more components of an electrical device, such as monitoring the condition of a brush of a brush holder assembly of a dynamo-electric machine.

BACKGROUND

A purpose of a brush in an electrical device is to pass electrical current from a stationary contact to a moving contact surface, or vice versa. Brushes and brush holders may be used in electrical devices such as electrical generators, electrical motors, and/or slip ring assemblies, or sliding connection applications, for example, slip ring assemblies on a rotating machine such as a rotating crane or a linear sliding connection on a monorail. Brushes in many electrical devices are blocks or other structures made of conductive material, such as graphite, carbon graphite, electrographite, metal graphite, or the like, that are adapted for contact with a conductive surface or surfaces to pass electrical current.

In some designs, a brush box type brush holder, or other type of brush holder, may be used to support a brush in contact with a moving contact surface of an electrical device during operation. The brush and brush box may be designed such that the brush can slide within the brush box to provide for continuing contact between the brush and the moving contact surface contacted by the brush. During operation an anomalous and/or threshold condition may occur, which may be indicative that one or more components of the electrical device may need to be replaced, one or more components of the electrical device may require inspection or attention, and/or maintenance may need to be performed. For example, an anomalous and/or threshold condition may indicate that one or more of a brush, brush holder, spring, shunt, commutator, collector ring, and/or other component may need to be replaced, one or more of a brush, brush holder, spring, shunt, commutator, collector ring, and/or other component may need to be inspected, and/or maintenance may need to be performed. It would be advantageous to monitor one or more components of an electrical device in order to observe the occurrence of an anomalous and/or threshold condition. Furthermore, it would be advantageous to alert an operator and/or technician of the occurrence of an anomalous and/or threshold condition and/or schedule technician intervention.

SUMMARY

Some embodiments relate to an apparatus, assemblies, systems and/or methods for monitoring one or more components of an electrical device and/or detecting an anomalous and/or threshold condition of a brush holder assembly.

Accordingly, one exemplary embodiment relates to a brush holder assembly for use in an electrical generator including a moving conductive surface. The brush holder assembly includes a brush holder that is configured to be removably mounted to a mounting element on the electrical generator. A carbon brush is slidingly disposed within the brush holder and is configured to be positioned in sliding contact with the moving conductive surface. The brush holder assembly includes a handle that is moveable between an unlocked position in which the brush holder is moveable relative to the mounting element and a locked position in which the brush holder is secured relative to the mounting element. A sensor is disposed within the handle that is configured to detect an anomalous or threshold condition of the brush holder assembly. In some instances, the sensor may be included with a circuit board disposed within the handle.

Another illustrative embodiment is a system for detecting an anomalous or threshold condition of each of a plurality of brush holder assemblies. The system includes a plurality of brush holder assemblies and a central monitoring station that is wirelessly coupled to each of the plurality of brush holder assemblies. Each of the brush holder assemblies includes a brush holder that is configured to be removably mounted to a mounting element on the electrical generator and a carbon brush slidingly disposed with the brush holder. A handle is coupled to the brush holder and a circuit board is disposed within the handle, the circuit board including a sensor that is configured to detect an anomalous or threshold condition of the brush holder assembly. Each of the brush holder assemblies includes a wireless communications module operably coupled to the sensor. The system also includes a central monitoring system that is wirelessly coupled to each of the wireless communication modules within each of the plurality of brush holder assemblies.

An illustrative method for detecting an anomalous or threshold condition of each of a plurality of brush holder assemblies may include providing each of a plurality of brush holder assemblies with a circuit board including a sensor that is configured to detect a developing anomalous or threshold condition of the brush holder assembly. The method includes receiving a signal from each of the plurality of brush holder assemblies, the signal providing an indication of predicting an anomalous or threshold condition of the brush or other component associated with the particular one of the plurality of brush holder assemblies at a future time. An alert may be sent out if one of the brushes has an indication justifying replacement of the brush.

The above summary of some example embodiments is not intended to describe each disclosed embodiment or every implementation of the invention.

BRIEF DESCRIPTION OF THE DRAWINGS

The invention may be more completely understood in consideration of the following detailed description of various embodiments in connection with the accompanying drawings, in which.

Figure 1:
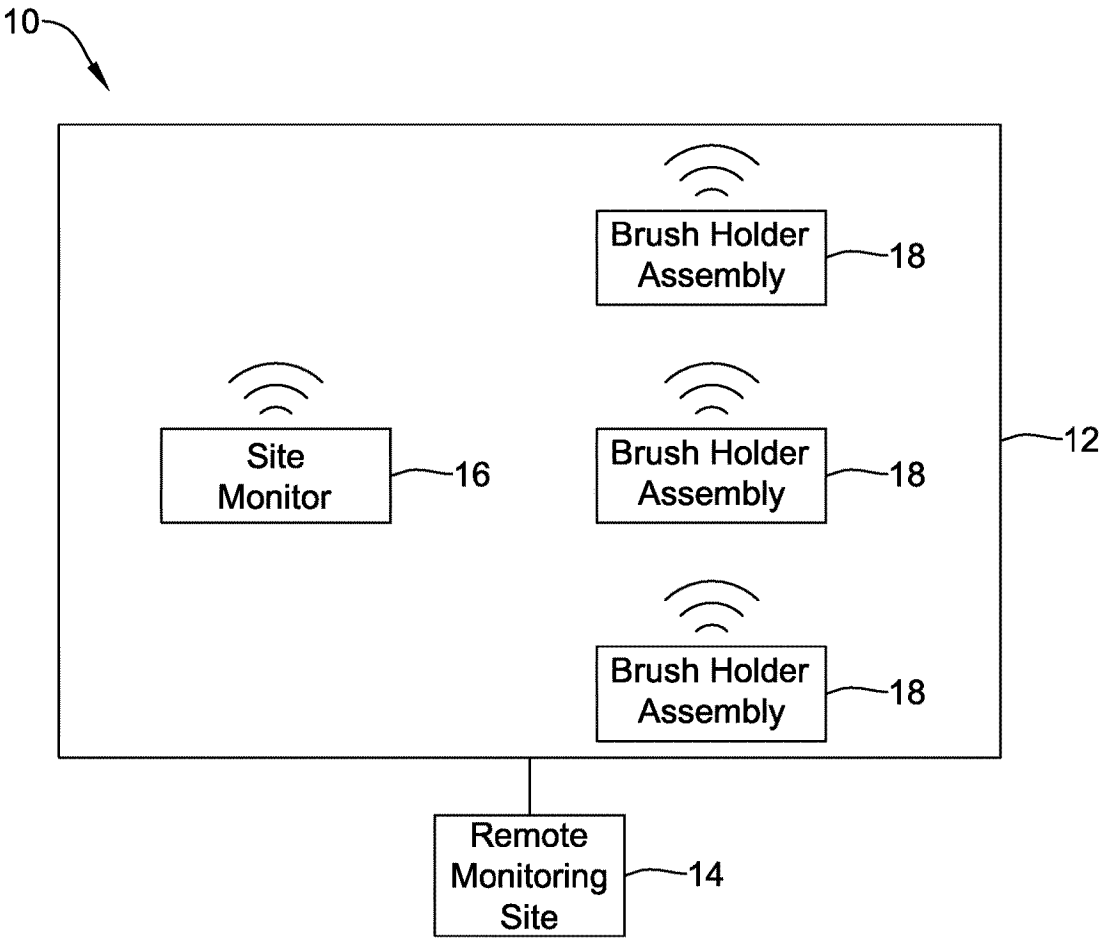
FIG. 1 is an illustrative schematic view of an exemplary brush monitoring system.

While the invention is amenable to various modifications and alternative forms, specifics thereof have been shown by way of example in the drawings and will be described in detail. It should be understood, however, that the intention is not to limit aspects of the invention to the particular embodiments described. On the contrary, the intention is to cover all modifications, equivalents, and alternatives falling within the spirit and scope of the invention.

DETAILED DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (i.e., having the same function or result). In many instances, the term "about" may be indicative as including numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following detailed description should be read with reference to the drawings in which similar elements in different drawings are numbered the same. The detailed description and the drawings, which are not necessarily to scale, depict illustrative embodiments and are not intended to limit the scope of the invention. The illustrative embodiments depicted are intended only as exemplary. Selected features of any illustrative embodiment may be incorporated into an additional embodiment unless clearly stated to the contrary.

Now referring to FIG. 1, an illustrative system for monitoring a component of an electrical device and/or monitoring the condition of a brush of a brush holder assembly is shown. As schematically illustrated in FIG. 1, a monitoring system 10 may include a local monitoring component 12 and a remote monitoring site 14. While a single local component 12 is shown, it will be appreciated that in some instances a plurality of local components 12 may be in communication with and reporting brush conditions and/or the condition of one or more other components of the brush holder assembly back to the remote monitoring site 14. The local component 12, which may for example represent a single electrical generator, or perhaps a single installation having several distinct electrical generators, includes a site monitor 16 and a plurality of brush holder assemblies 18. While a total of three brush holder assemblies 18 are schematically illustrated, it will be appreciated that this is merely for ease of illustration. In some instances, for example, a single electrical generator may include 12, 24, 36, 48 or more separate brush holder assemblies 18 arranged around a moving conductive surface (e.g., commutator).

As can be seen, each of the brush holder assemblies 18 may be configured to communicate wirelessly with the site monitor 16. Any suitable wireless communications protocol may be used, including but not limited to WiFi, RFID, Bluetooth and the like. Optionally, the communication between each of the brush holder assemblies 18 and the site monitor 16 may be via wired communication. In some cases, each of the brush holder assemblies 18 may be configured to monitor some aspect or feature of the brush holder assembly 18. For example, in some cases, each of the brush holder assemblies 18 or at least some of the brush holder assemblies 18 may be configured to monitor for anomalous or threshold conditions of the brush associated with (e.g., disposed within) the brush holder assembly. Each brush holder assembly 18 may, for example, periodically transmit information to the site monitor 16 pertaining to whether any anomalous or threshold conditions have been detected. In some cases, each brush holder assembly 18 may transmit in accordance with a predetermined or user-selectable time frame. For example, periodic transmissions may be periodically transmitted every hour, once a day, etc. In some instances, each brush holder assembly 18 may only transmit information if the information has changed since the last time it was transmitted. This may, for example, reduce the power consumption of the brush holder assembly 18.

As noted, the local component 12 may be a single electrical generator or a group of several electrical generators. Each of several different electrical generators may report brush condition information, including any detected anomalous or threshold conditions, to the site monitor 16. In turn, the site monitor 16 may transmit information regarding the condition of one or more components of the brush holder assembly 18, such as brush condition information, as well as other information if desired, to the remote monitoring site 14. In some cases, for example, several electrical generators, each representing a local component 12, may be located within a building. Each local component 12, having its own site monitor 16, may transmit information to the remote monitoring site 14, which may in this case represent a monitoring system for the building. In some cases, the local component 12 may represent a plurality of electrical generators in a building, and the remote monitoring site 14 may receive information from a plurality of different buildings. The remote monitoring site 14 may, for example, receive monitoring information from a number of local components 12 within a particular geographic region.

Thus, as currently disclosed the monitoring system 10 may monitor the condition of a brush or a plurality of brushes within a brush holder assembly and/or one or more other components of an electricity generating facility, for example. In some embodiments, the monitoring system 10 may remotely and/or wirelessly monitor the condition of a brush, a plurality of brushes and/or other components over a period of time, and thus may detect a developing problem or condition and/or predict an anomalous or threshold condition of a brush, a plurality of brushes and/or other components at a future time. A processing or control center, such as a central control center, may receive data from multiple facilities in order to monitor performance, such as brush performance (e.g., brush wear) at each of the multiple facilities. The control center may be located remote from one or more electrical facilities (e.g., in a different building, facility, city, county, state, country, etc.).

A processing unit, which may be located at the control center, may use a software program and/or a monitor to analyze and/or monitor the performance of the brushes and/or other components in operation at the facilities, such as the current state of each brush in operation and/or an anomalous and/or threshold condition of the brushes. The software program or monitor may alert an operator, technician and/or other personnel that a brush at one of the remote electrical facilities is sufficiently worn and/or needs to be replaced, a brush at one of the remote electrical facilities is damaged, failure has occurred or is imminent, or other maintenance may need to be performed. In some embodiments, the software program, or a technician at the control center, may schedule maintenance for one of the remote electrical facilities, send personnel to perform maintenance at one of the remote electrical facilities, order and/or schedule distribution/delivery of a replacement brush or other part to one of the remote electrical facilities, route maintenance personnel and/or product delivery to a specified location, such as one of the remote electrical facilities, or arrange for other notification and/or scheduling tasks be performed at one of the remote electrical facilities or another location. Thus, the monitoring system 10 may continuously monitor the state of brushes and/or other components at a plurality of remote locations with or without direct human observation in order to alleviate the need of monitoring personnel at each remote location until it is determined that human intervention is necessary to attend to an identified problem or matter.

Figure 2:
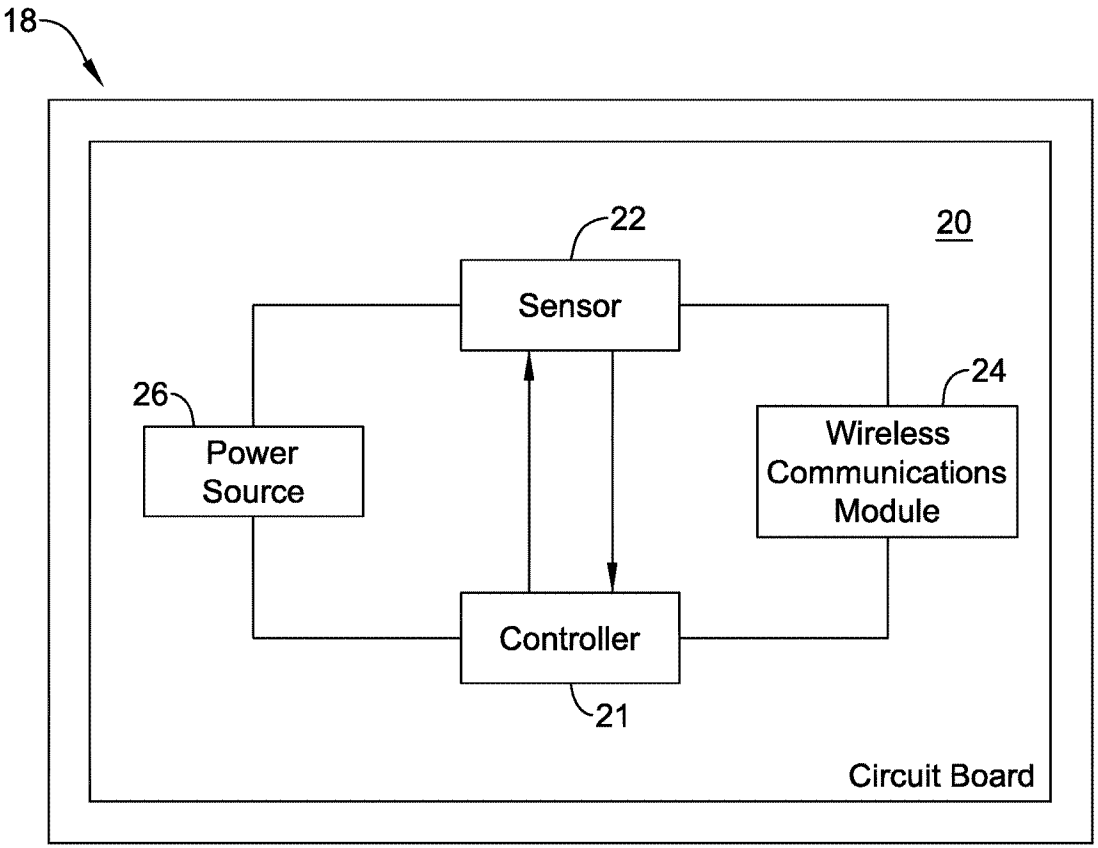
FIG. 2 is an illustrative schematic view of an exemplary brush holder assembly.

Turning to FIG. 2, features of the brush holder assembly 18 are schematically illustrated. The brush holder assembly 18 includes a number of mechanical parts and elements that are not illustrated in FIG. 2. The brush holder assembly 18 includes a circuit board 20 that may be physically located within a handle (discussed with respect to subsequent Figures) of the brush holder assembly 18 or at a different location and/or in a different component, if desired. The circuit board 20 includes a sensor 22 that may be configured to detect an anomalous or threshold condition of a brush within the brush holder assembly 18.

A variety of different sensors 22 are possible, as will be discussed. A wireless communications module 24 is operably coupled with the sensor 22 such that the wireless communications module 24 may output a signal received from the sensor 22 that is indicative of the condition of the brush and/or other components of the brush holder assembly 18. The circuit board 20 includes a power source 26 that is operably coupled to and powering the sensor 22 and the wireless communications module 24. In some cases, the power source 26 may be a battery. In some instances, the power source 26 may be an energy harvesting element such as a Hall sensor, and may include a battery that is kept charged via the energy harvesting element. For example, illustrative energy harvesting technologies may include a kinetic (e.g., vibrational) energy harvester (e.g., a piezoelectric vibration energy harvester, a magneto-inductive vibration energy harvester, etc.), a photovoltaic energy harvester capable of harvesting energy indoors and/or outdoors, a piezoelectric energy harvester, a thermal energy harvester, a wind energy (e.g., microturbine) harvester, and/or an ambient radiation (e.g. radio frequency) energy harvester.

In some cases, in addition to or instead of the power source 26, the brush holder assembly 18 may include one or more connectors and/or terminals capable of receiving power from a separate source. In such cases, the brush holder assembly 18 may be configured to receive power from an external power source when the brush holder assembly 18 is installed. For example, an electrical circuit may be completed when the brush holder assembly 18 is coupled to the mounting block 34 such that electrical power may pass from a power source through the mounting block 34.

The circuit board 20 also includes a processor or controller 21. The controller 21 is powered by the power source 26, and is operably coupled to the sensor 22 and the wireless communications module 24. The controller 21 may be configured to control operation of the sensor 22, as well as to interpret the information provided by the sensor 22 to determine the condition of the brush of the brush holder assembly 18. For example, if the sensor 22 is a photo cell that is configured to detect arcing, the controller 21 may analyze a signal obtained from the photo cell, in order to determine whether arcing is occurring. If the sensor 22 is a microphone, the controller 21 may be configured to analyze an electrical signal from the microphone and determine if there are sounds present that indicate arcing and/or abnormal vibration. If the sensor 22 is a light source, for example, the controller 21 may be configured to analyze a time-of-flight for light to leave the light source and be reflected back to a light-sensitive receiver, and determine a distance to the brush and thus an indication of brush wear. The distance the light must travel will vary as the brush wears, and thus the top surface of the brush will move further from the light source as the brush wears, resulting in a longer distance and travel time for the light. Similarly, if the sensor 22 is an ultrasound transducer, the controller 21 may be configured to analyze the time-of-flight for sound to travel from the ultrasound transducer and be reflected back to an ultrasound sensor in order to determine a distance to the brush and thus an indication of brush wear. The distance the sound must travel will vary as the brush wears, and thus the top surface of the brush will move further from the ultrasound transducer as the brush wears, resulting in a longer distance and travel time for the sound. If the sensor 22 is a magnetic sensor, with a permanent magnet mounted relative to the brush, the controller 21 may be configured to analyze a detected magnetic field strength in order to determine a distance to the brush and thus an indication of brush wear as the magnet moves away from the magnetic sensor.

Figure 3:
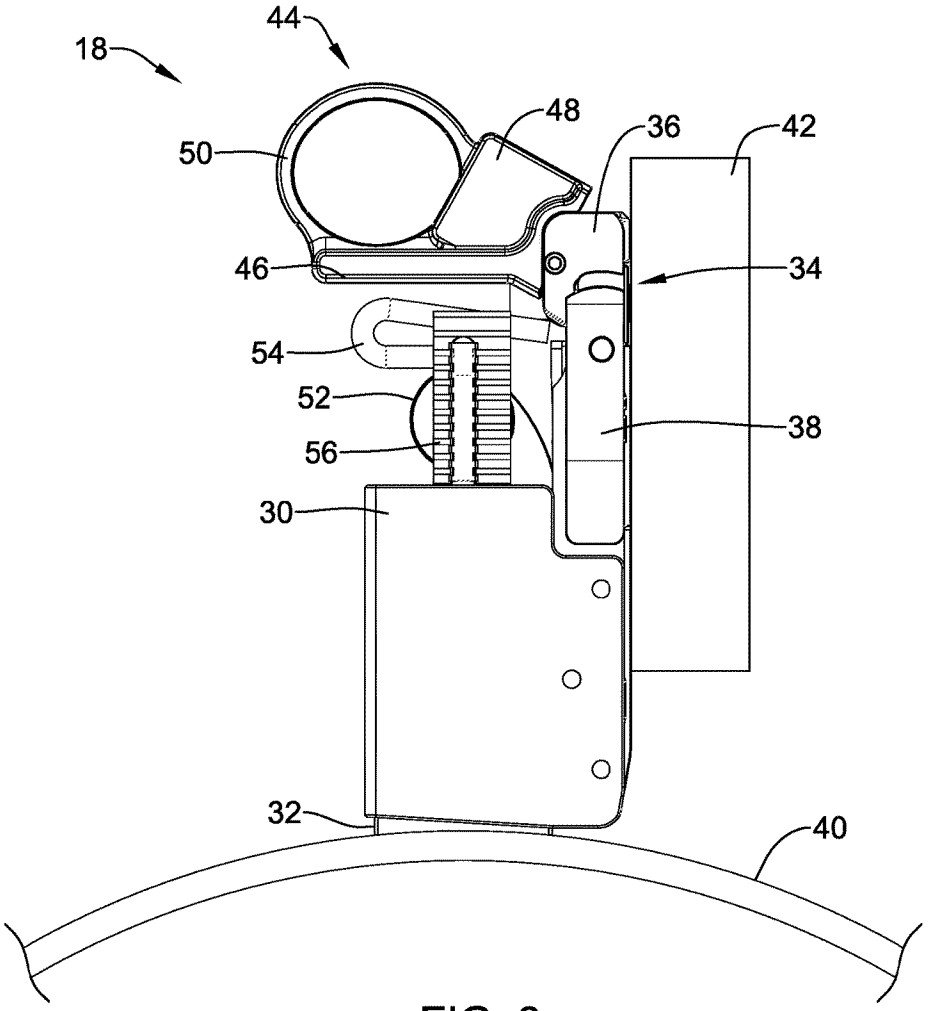
FIG. 3 is an illustrative side view of an exemplary brush holder assembly in a locked position, relative to a moving conductive surface.
Figure 4:
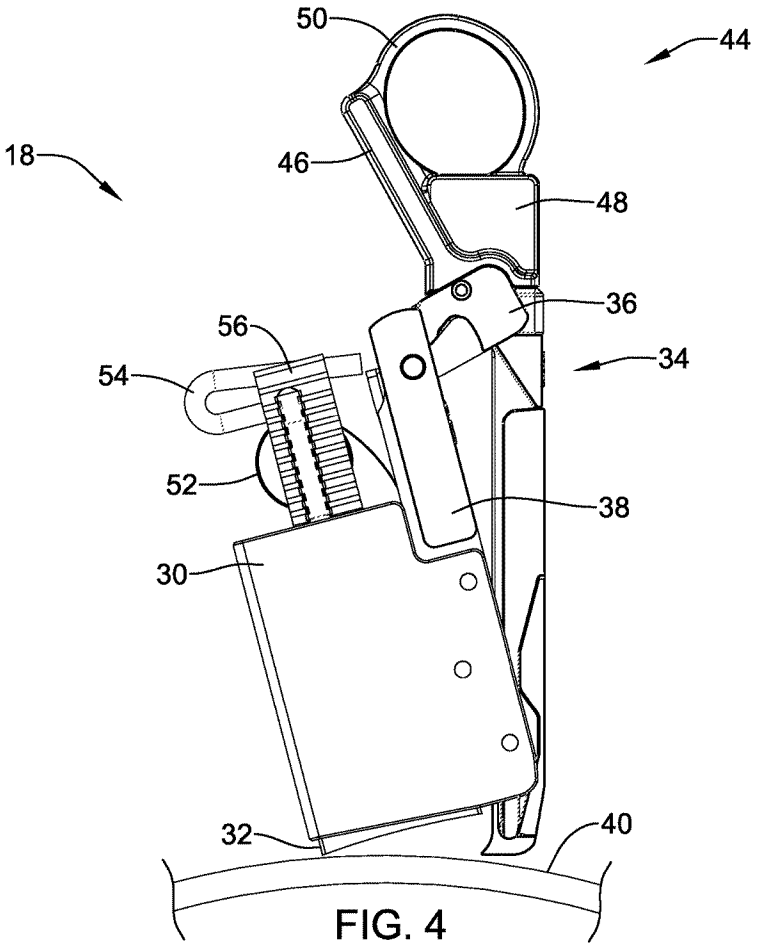
FIG. 4 is an illustrative side view of the brush holder assembly of FIG. 3, shown in an unlocked position.

Further features of the brush holder assembly 18 may be seen in FIGS. 3 and 4. FIG. 3 shows the brush holder assembly 18 in its locked position while FIG. 4 shows the brush holder assembly 18 in its unlocked position. The brush holder assembly 18, for example, may include a brush holder 30 such as a brush box surrounding a brush 32 on several sides and including a plurality of guiding surfaces for guiding linear or longitudinal movement of the brush 32. In some embodiments, the brush holder 30 may not take on the form of a box, but may include one or a plurality of guiding surfaces, such as channels, posts or columns, abutting and/or encompassing one or more sides of the brush 32 and/or extending into or through the brush 32, or a portion thereof, for guiding linear or longitudinal movement of the brush 32.

The brush holder 30 may be secured to a mounting beam 34 configured and adapted to be mounted to another structure, such as a mounting block 42. The brush holder assembly 18 is configured to place the brush 32 in contact with a moving contact surface 40, such as a conductive surface of a commutator or a collector ring, and conduct current therefrom. The brush 32 may extend from the lower edge of the brush holder 30 such that a wear surface of the brush 32 engages the moving contact surface 40. The mounting beam 34 may include an over-center engagement mechanism, a slotted or channeled engagement mechanism for sliding engagement, or other mechanism for easily engaging and disengaging the brush 32 from a moving contact surface 40, such as the conductive surface of a commutator or a collector ring without stopping the electrical generator. In other embodiments, the brush holder assembly may include a brush holder rigidly mounted to another structure holding the brush holder stationary, or mounted to another structure in any desired arrangement. For example, in some embodiments the brush holder may be bolted or welded to a stationary structure. Some such brush holders are disclosed in U.S. Pat. Nos. 6,731,042; 5,753,992; 5,621,262; 5,463,264; 5,397,952; and 5,256,925; which are incorporated herein by reference.

As shown in FIG. 3, the mounting beam 34 may include an upper beam member 36 and a lower beam member 38 hingedly or pivotedly coupled to one another. When the upper beam member 36 and the lower beam member 38 are aligned with one another (e.g., the longitudinal axis of the upper beam member 36 is parallel with the longitudinal axis of the lower beam member 28), the brush holder 18 may be considered to be in an engaged, or locked, position such that the brush 32 may be contiguous with or in contact with the moving contact surface 40. When the upper beam member 36 is tilted from the lower beam member 38 (e.g., the longitudinal axis of the upper beam member 36 is oblique to the longitudinal axis of the lower beam member 38), the brush holder 18 may be considered to be in a disengaged, or unlocked, position such that the brush 32 may be non-contiguous with, spaced from, or otherwise not in direct electrical contact with the moving contact surface 40. The mounting beam 34 may be removably coupled to the mounting block 42 during operation. In some embodiments, the mounting beam 34 may slidably engage with, interlock with, or otherwise be removably coupled to the mounting block 42. The mounting block 42 may be coupled to, secured to, or otherwise extend from another structure which maintains the mounting block 42 stationary with respect to the moving contact surface 40, for example.

In some embodiments, a handle 44 may be attached to the brush holder 30 to facilitate engagement and disengagement of the brush 32 from the moving contact surface 40 without stopping the electrical generator. For example, the handle 44 may be attached to the upper beam member 36 such that movement of the handle 44 actuates (e.g., pivots, slides, releases) the upper beam member 36 relative to the lower beam member 38. In some cases, as illustrated, the handle 44 may be considered as including a lower portion 46, an upper portion 48 that is at least substantially transverse to the lower portion 46, and an intervening finger ring 50 that is configured to facilitate movement of the handle 44. Other handle designs are contemplated.

Also illustrated in FIG. 3 is a brush spring 52, such as a constant force spring, which provides tension to the brush 32 to bias the brush 32 toward and in contact with the moving contact surface 40. The spring 52 may be attached to a portion of the brush holder 30 or the mounting beam 34 of the brush holder assembly 18, for example. In some embodiments, the spring 52 may extend along one side surface of the brush 32 between the brush 32 and the brush box and/or mounting beam 34 of the brush holder assembly 18. Electrical leads 54 (one is visible in this view) extend from the brush 32 and are guided at least in part by a lead guide 56 that is disposed above the brush 32 and in some cases moves vertically with the brush 32 as the brush 32 moves in accordance with wear. The brush 32 is biased to move towards the moving contact surface 40 by the spring 52.

In some embodiments, at least some features of the brush holder assembly 18 may substantially resemble a brush holder assembly as described in U.S. patent application Ser. No. 10/322,957, entitled "Brush Holder Apparatus, Brush Assembly, and Method", which is herein incorporated by reference in its entirety. However, the illustrative monitoring system 10 may be amenable to any of various electrical devices and/or brush holder assembly configurations of an electrical device, such as an industrial electrical generator. For example, the disclosed monitoring system 10 may be used with brush holder assemblies, brush holders and/or brushes disclosed in U.S. Pat. Nos. 6,731,042; 5,753,992; 5,621,262; 5,463,264; 5,397,952; and 5,256,925; each of which is incorporated herein by reference.

Figure 5:
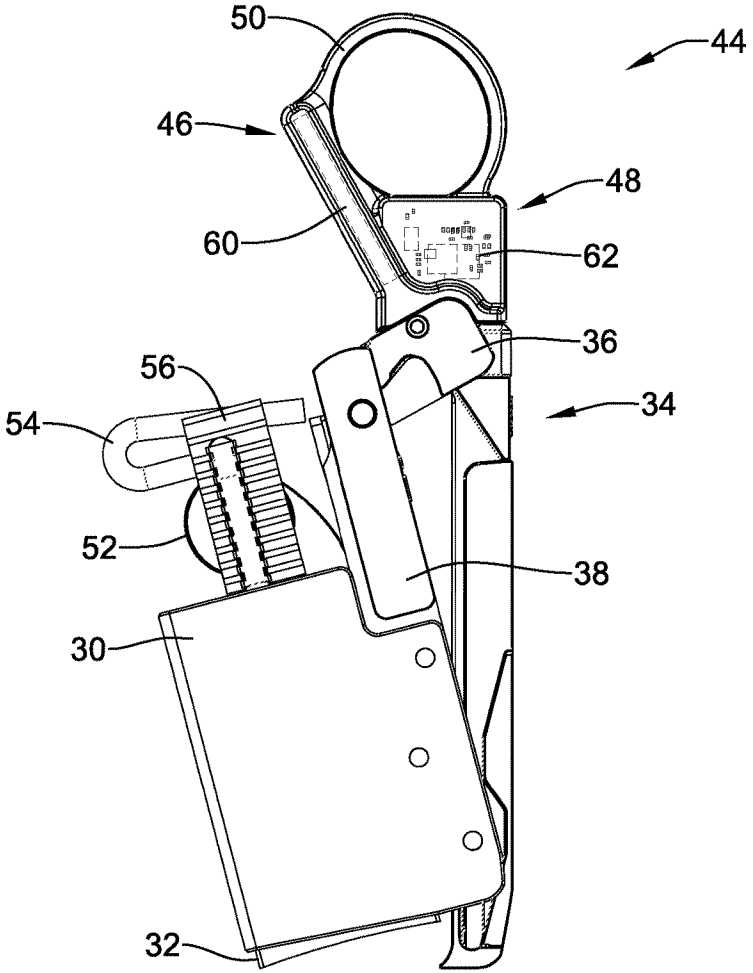
FIG. 5 is an illustrative perspective view of the brush holder of FIG. 4, with part of the handle shown in phantom to illustrate components within the handle.
Figure 6:
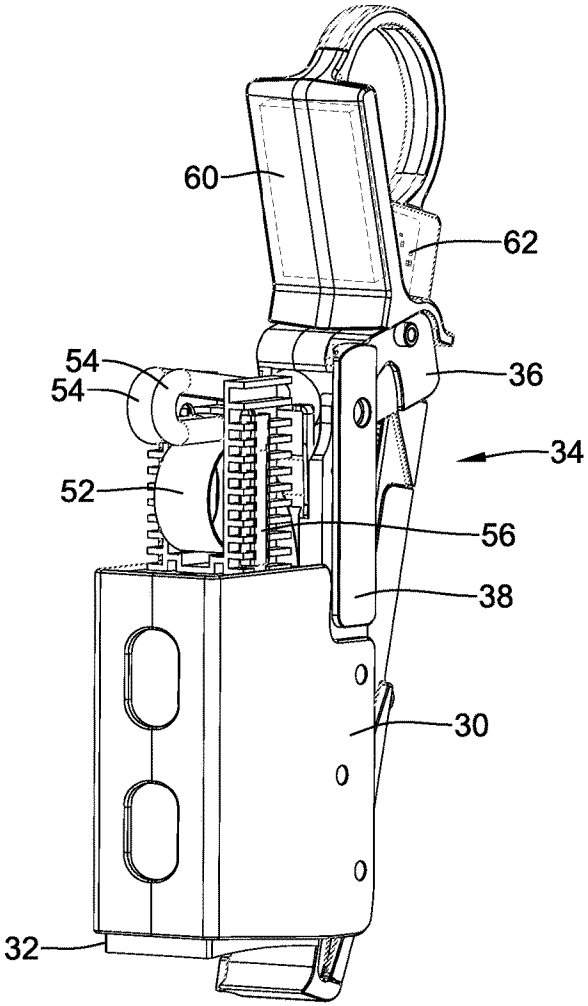
FIG. 6 is an illustrative perspective view of the brush holder of FIG. 4, with part of the handle shown in phantom to illustrate components within the handle.

As schematically shown in FIG. 2, the brush holder assembly 18 may include a circuit board 20 including one or more of a controller 21, a sensor 22, a wireless communications module 24 and a power source 26. The circuit board 20 may be disposed at any desired or practical location on or within the brush holder assembly 18. In some embodiments, the circuit board 20 may be disposed within the handle 44. FIGS. 5 and 6 are views of the brush holder assembly 18 in which outer portions of the handle 44 have been removed or otherwise made invisible such that a first circuit board 60 may be seen as being disposed within the lower portion 46 of the handle 44 and a second circuit board 62 may be seen as being disposed within the upper portion 48 of the handle 44. In some cases, the first circuit board 60 and the second circuit board 62 are electrically coupled to each other. In some cases, the brush holder assembly 18 may include only one of the first circuit board 60 and the second circuit board 62. It will be appreciated that in some cases, the sensor 22 may be disposed on the first circuit board 60.

Figure 7:
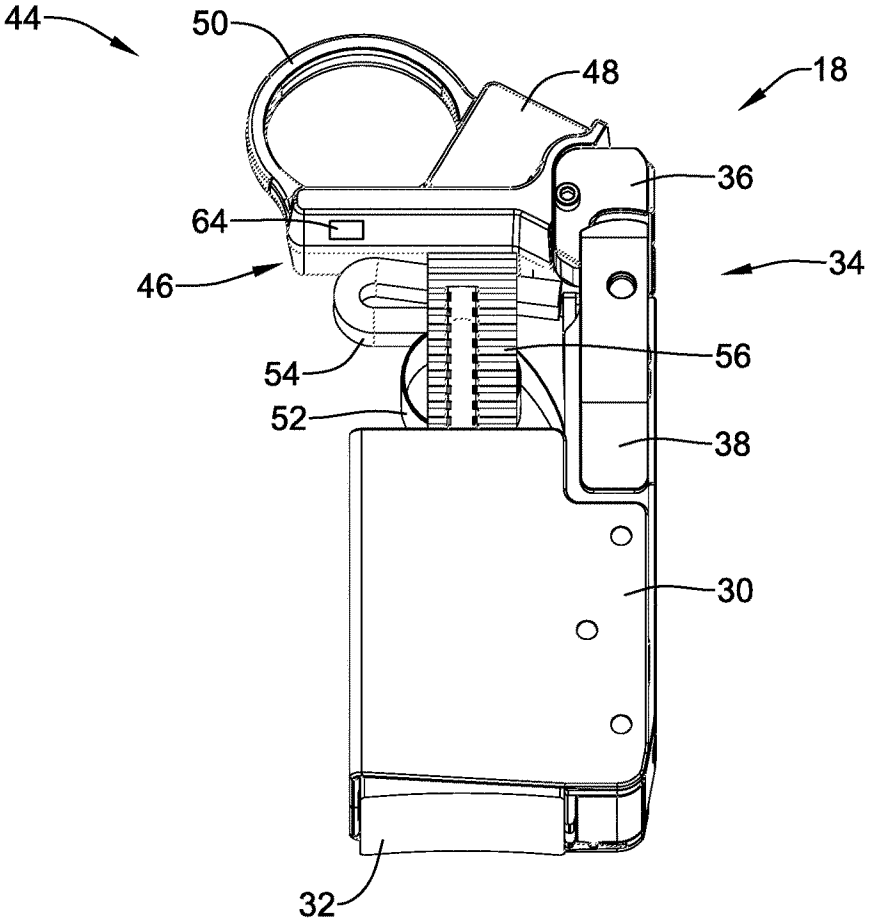
FIG. 7 is an illustrative perspective view of the brush holder assembly of FIG. 3, schematically illustrating possible sensor placement.

Turning to FIG. 7, in some embodiments the brush holder assembly 18 may be considered as including an optical device 64, such as a photo cell or digital camera. The optical device 64 may be operably coupled to the first circuit board 60 and/or the second circuit board 62, and may in some cases be aimed at a location just forward of the brush box 30, such as a location within 5 inches, within 4 inches, within 3 inches, within 2 inches, or within 1 inch of the brush box 30 and/or brush 32, such that the optical device 64 can see the moving contact surface 40 (FIG. 3). In some cases, the controller 21 (FIG. 2) may analyze a signal provided by the optical device 64 to look for indications of arcing or other potentially destructive processes.

In some instances the optical device 64 may be an imaging device configured to capture an analog and/or digital image of one or more components of the electrical device. For instance, the imaging device may capture an image of the moving contact surface 40 (e.g., the commutator or collector ring) of the electrical device and/or a brush 32 of a brush holder assembly 18, or another component of the electrical device. In some embodiments, at a temporal occasion the imaging device may capture images of the moving contact surface 40 at about one-half inch increments, about 1 inch increments, about 2 inch increments, about 3 inch increments, or about 4 inch increments around the circumference of the moving contact surface 40, for example. The image may be a black-and-white image, a gray scale image, a color image, or a thermograph (e.g., an image depicting levels of emitted radiation), for example.

In one embodiment, the imaging device, which may detect energy in the visible light spectrum, may generate a data signal which may be processed and/or may be converted into an image. With such an imaging device, evaluation of the coloration (e.g., discoloration) of the moving contact surface 40, or other component of the electrical device may be performed in order to determine a condition of a brush 32 of a brush holder assembly 18, a collector ring or commutator, or other component of an electrical device. For instance, the imaging device may be used to identify abnormal coloration of the moving contact surface 40.

During normal operating conditions the moving contact surface 40 may exhibit normal coloration. In many applications, normal coloration of the moving contact surface 40 may be a shade of gray, for example. During operation, the coloration of the moving contact surface 40 may change, which may be indicative of a threshold and/or anomalous condition of the brush 32 of the brush holder assembly 18. Such a threshold and/or anomalous condition of the brush 32 may include incidents of irregular wear, binding, arcing, burning, etching, or the like. Thus, processing and/or evaluation of a signal generated by the imaging device may be used to determine whether a threshold and/or anomalous condition of the brush 32 or other component has occurred.

Thus, initially, the moving contact surface 40 may be identified as having a first color, shade or intensity of coloration. At a subsequent time, the moving contact surface may be identified as having a second color, shade or intensity of coloration different from the first color, shade or intensity of coloration. In some circumstances, the second color, shade or intensity of coloration may be less than the first color, shade or intensity of coloration. However, in other circumstances, the second color, shade or intensity of coloration may be greater than the first color, shade or intensity of coloration. For instance, lightening in color, shade or intensity of coloration of the moving contact surface 40 may be an indication of arcing, causing burning and/or etching of the moving contact surface 40. For example, in applications where normal coloration of the moving contact surface 40 may be a shade of gray, a threshold or anomalous condition may be identified when the coloration of the moving contact surface 40 changes to another shade of gray, such as a lighter or darker shade of gray.

In another embodiment, the imaging device, which may detect energy in the infrared spectrum, may generate a data signal which may be processed and/or may be converted into a thermal image. All objects emit radiation and the level of radiation emitted by an object increases with temperature. Therefore, an infrared camera or other thermal imaging device may be used in order to detect variations and/or changes in temperature of a component of an electrical device, such as the moving contact surface 40 of an electrical device and/or the brush 32 of a brush holder assembly 18.

During normal operating conditions, the moving contact surface 40 and/or the brush 32 of the brush holder assembly 18 may emit a given level of radiation, which may be described as a normal level of radiation. The level of emitted radiation may be depicted with a thermograph (e.g. a thermal image) through color, shade or intensity of the illustrated component. During operation, the level of radiation emitted by the moving contact surface 40 and/or the brush 32 of a brush holder assembly 18 may increase, indicating an increase in temperature of the moving contact surface 40 and/or the brush 32 of a brush holder assembly 18. Increased temperature of the moving contact surface 40 and/or the brush 32 of a brush holder assembly 18 may be indicative of a threshold and/or anomalous condition of the brush 32 or other component of the brush holder assembly 18. Such a threshold and/or anomalous condition of the brush 32 may include incidents of irregular wear, binding, arcing, vibration, burning, etching, or the like. Thus, processing and/or evaluation of a signal generated by the imaging device 64 may be used to determine whether a threshold and/or anomalous condition of the brush 32 or other component has occurred.

For instance, during normal operating conditions, the moving contact surface 40 and/or the brush 32 of a brush holder assembly 18 may typically have a surface temperature in the range of about 150° F. to about 250° F., or in the range of about 180° F. to about 200° F. Thus, a thermal image of the moving contact surface 40 and/or the brush 32 of a brush holder assembly 18 may visually depict the temperature (i.e. the level of emitted radiation) of a component of the electrical device with color, shade or intensity. As the temperature of the moving contact surface 40 and/or the brush 32 of a brush holder assembly 18 increases, the color, shade or intensity illustrative of the temperature changes accordingly. Thus, variations in the level of emitted radiation corresponding to increased or decreased temperature of a component of the electrical device may be identified through evaluation of successive thermal images showing varying levels of color, shade or intensity of a component of an electrical device, such as the moving contact surface 40 and/or the brush 32 of a brush holder assembly 18. For instance, one level of color, shade or intensity gradation of a thermal image may represent a temperature variation of about 1° F., about 2° F., about 5° F., about 10° F., or about 20° F. of the monitored component. Thus, the temperature of a monitored component may be determined through evaluation of a thermal image where the temperature associated with a given level of color, shade or intensity is known or approximated.

Processing and/or evaluation of the signal by the controller 21 may include an image analysis technique, such as a pixel-by-pixel comparison or visual observation, for example. However, other techniques may be used in processing and/or evaluation of data acquired. Pixel-by-pixel comparison involves comparing a first digital image with a second, or subsequent, digital image. It is noted that in using the terms "first" and "second", the terms are intended to denote the relative temporal relationship of the images only. An algorithm, for example, may be used to systematically compare data denoting pixels of one digital image with data denoting pixels of a second digital image. A pixel is the smallest independent part of a digital image and may have the properties of color, shade and/or intensity. The resolution of the digital image is determined by the quantity of pixels creating the digital image (e.g., the greater the number of pixels, the greater the resolution of the digital image). A digital image is characterized as an array of pixels. The digital image may be divided into any sized array and may be dictated by the quality of imaging equipment and/or memory available. For example, the digital image may be an 800×600, 1024×768, or 1600×1200 array of pixels. Each pixel is identified by an integer denoting the value (e.g., color, shade and/or intensity) of the individual pixel. For example, each pixel may be specified by a "0" or a "1" denoting black or white respectively; or an integer between 0 and 255 denoting 256 shades of grey; or three integers between 0 and 255 each denoting a red, blue and green component, respectively with 256 levels for each component; or an integer between 0 and 1023 denoting 1024 infra-red levels, or other identifiable values. Thus, the color, shade and/or intensity of each pixel may be denoted by a representative integer. It may be understood that the digital identification of each pixel may be determined by the number of bits available for data regarding each pixel.

The controller 21 may be able to evaluate the pixels of the digital images acquired to determine if an anomalous and/or threshold condition exists. In some embodiments, the controller 21 recognizes the known value of pixels representing the normal coloration or the normal level of emitted radiation of a component of the electrical device. Thus, evaluation of the digital images may involve assessing the value of pixels of the digital images at a given time with known values corresponding to normal coloration or level emitted radiation of a component of the electrical device. If discoloration or abnormal coloring or increased levels of emitted radiation is determined, proper notification may be performed.

In some embodiments, the optical device 64 may be configured to detect wavelengths of light that are indicative of arcing, and to not see other wavelengths of light. If the optical device 64 is blind to wavelengths of light that are not indicative of arcing, any light registered by the optical device 64 is presumably indicative of arcing, and thus the optical device 64 may be able to provide a simple binary response of yes, arcing; or no, no arcing based simply on whether any light incident on the optical device 64 triggers the optical device 64.

In some embodiments, the optical device 64 may instead be aimed at a point on an upper surface of the brush 32, or perhaps a point on the lead guide 56 or other component moving with the brush 32. As noted above, the lead guide 56 may be operably coupled to the brush 32, and thus may move vertically downward with the brush 32 (and thus toward the moving conductive surface 40) as the brush 32 moves downward with increasing brush wear as a result of the biasing force applied by the spring 52. In some cases, the optical device 64 may be tightly focused on a small point, providing an image with a limited number of pixels. If the distance between the optical device 64 and the focal point increases, the number of pixels within the tightly focused region will actually decrease. Thus, a change in the number of visible pixels may indicate an increase in distance. Since the brush 32 moves downward (in the illustrated orientation) in response to brush wear, an increasing distance (indicated by a reduction in visible pixels) may provide an indication of brush wear.

Figure 8:
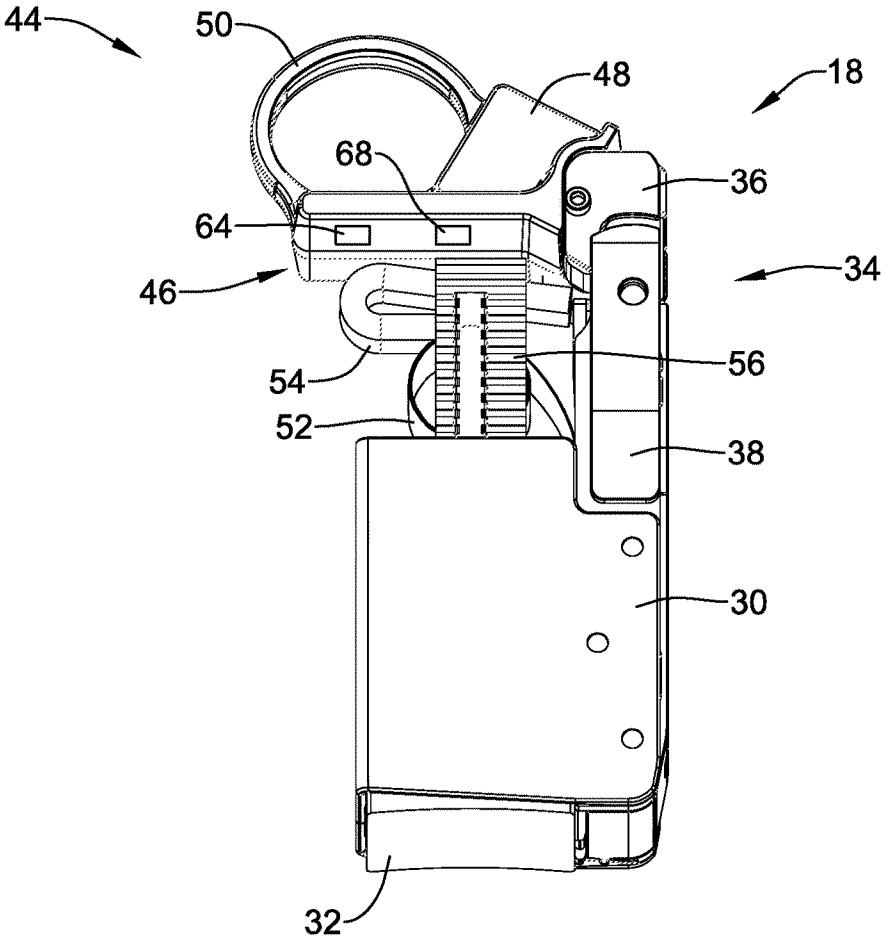
FIG. 8 is an illustrative perspective view of the brush holder assembly of FIG. 3, schematically illustrating possible sensor placement.

In some instances, such as illustrated in FIG. 8, the sensor 22 may actually include a source element 66 and a receiver element 68. For example, the source element 66 may be a laser beam or other light source, and the receiver element 68 may be photosensitive. A light beam (such as a laser beam) may be provided by the source element 66, which may be positioned such the light contacts and is reflected by either a top surface of the brush 32, or perhaps the lead guide 56 or other component moving with the brush 32, and is then detected by the receiver element 68. By a simple calculation of distance equals rate times time, and given that the speed of transmission (of light, in this case) is known, and constant, the controller 21 can determine a distance to the brush 32 based upon the time-of-flight of the light beam.

In some cases, the source element 66 may be an ultrasonic transducer, and the receiver element 68 may be an ultrasonic receiver. A sound wave (such as an ultrasonic sound wave) may be provided by the source element 66, which may be positioned such the sound wave contacts and is reflected by either a top surface of the brush 32, or perhaps the lead guide 56 or other component moving with the brush 32, and is then detected by the receiver element 68. By a simple calculation of distance equals rate times time, and given that the speed of transmission (of sound, in this case) is known, and substantially constant at a given altitude and temperature, the controller 21 can determine a distance to the brush 32 based upon the time-of-flight of the sound wave.

Figure 9:
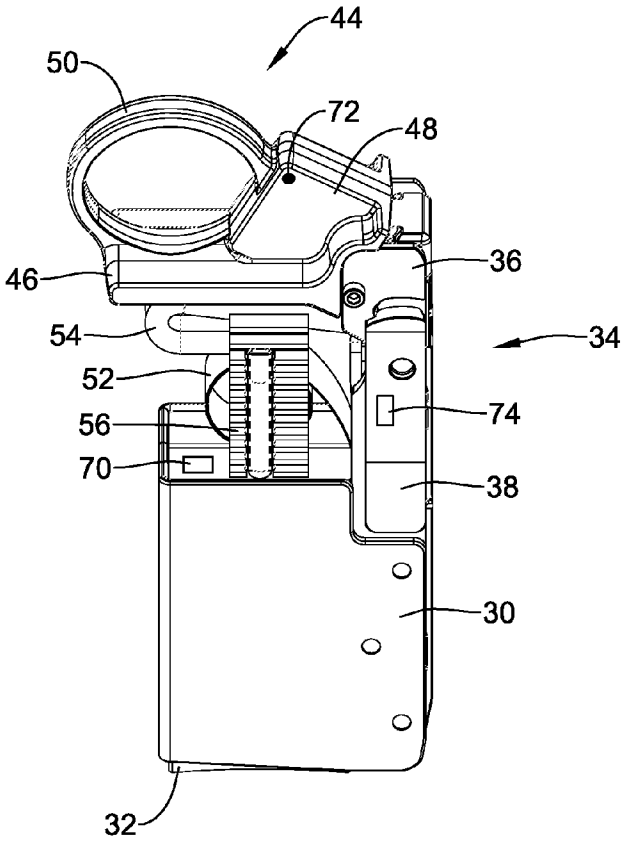
FIG. 9 is an illustrative perspective view of the brush holder assembly of FIG. 3, showing an upper surface of the carbon brush.

In some embodiments, the sensor 22 may be a magnetic sensor, with a permanent magnet secured relative to the brush 32 or the lead guide 56. FIG. 9 illustrates a permanent magnet 70 that has been secured to a top surface of the brush 32. In some cases, the permanent magnet 70 may, for example, be adhesively secured to the brush 32, or perhaps the lead guide 56 or other component moving with the brush 32. It will be appreciated that changes in distance between the magnetic sensor 22 and the permanent magnet 70 will be reflected in the relative strength of the detected magnetic field. Accordingly, if the detected magnetic field decreases in strength, the controller 21 may determine that the distance to the brush 32 has increased as a result of brush wear.

In some cases, the brush holder assembly 18 may include a user interface 72, which is schematically illustrated in FIG. 9. For example, the user interface 72 may be a light such as an LED that can have a first appearance indicating that no problems have been detected by the controller 21 (e.g., the brush holder assembly 18 is functioning in a normal state) and a second appearance different from the first appearance that indicates that a problem has been detected (e.g., the brush holder assembly 18 is functioning in an abnormal state and/or a threshold or anomalous condition has been detected). In some embodiments, green may indicate an absence of problems, yellow may indicate an approaching problem, and red may indicate a serious or immediate problem. In some instances, particularly if power consumption is a concern, an unlit or dark light may indicate an absence of problems, and a lit light (of whatever color) may be an indication that a problem has been detected. In some cases, the user interface 72 may instead provide an auditory signal, particularly if a serious or immediate problem has been detected by the controller 21.

In some cases, the brush holder assembly 18 may include a thermal sensor 74. The thermal sensor 74 may be disposed at any convenient location on the brush holder assembly 18, but in some cases as schematically illustrated the thermal sensor 74 may be disposed on the mounting beam 34. The thermal sensor 74 may be any suitable temperature sensor, including but not limited to a thermistor or a bimetal temperature sensor. The thermal sensor 74 may be operably coupled to the controller 21 (FIG. 2), and may provide an electrical signal indicative of a temperature of a component of the brush holder assembly 18. It will be appreciated that the temperature of the component of the brush holder assembly 18 may be considered to be at least somewhat proportional to the power levels being captured by the brush 32. If the component of a particular brush holder assembly 18 has a temperature that is significantly different from that of a like component of one or more neighboring brush holder assemblies 18, the controller 21 will recognize that a problem potentially exists.

In some instances, each of a plurality of brush holder assemblies 18 may include a thermal sensor 74 such that an indication of temperature of a component of each of the plurality of brush holder assemblies 18 may be obtained simultaneously. For instance, each brush holder assembly 18 of a plurality of brush holder assemblies 18 mounted on an electrical generator or other dynamo-electric machine may include a temperature sensor for measuring a temperature of the brush, a lead extending from the brush, a terminal, or other component of the brush holder assembly 18. Accordingly, the thermal sensors of each of the brush holder assemblies 18 may simultaneously measure the temperature of the component (e.g., the brush, a lead extending from the brush, a terminal, etc.) of the associated brush holder assembly 18 which can be compared with one another. At any particular point in time, the power levels passing through each of the brushes 32 will generally be about the same. If one of the brushes 32 indicates a significant difference in power level passing through the brush 32, as indicated by a temperature difference between the like component of other brush holder assemblies 18 being monitored, this may be an indication that a problem exists.

In some cases, an amperage meter may be operably coupled to a component of each of the plurality of brush holder assemblies 18 in order to obtain a more direct indication of relative power levels between adjacent brushes 32. For instance, each brush holder assembly 18 of a plurality of brush holder assemblies 18 mounted on an electrical generator or other dynamo-electric machine may include an amperage meter for measuring an electrical current passing through the brush, a lead extending from the brush, a terminal, or other component of the brush holder assembly 18. Accordingly, the amperage meter of each of the brush holder assemblies 18 may simultaneously measure the current passing through the component (e.g., the brush, a lead extending from the brush, a terminal, etc.) of the associated brush holder assembly 18 which can be compared with one another. At any particular point in time, the power levels passing through each of the brushes 32 will generally be about the same. If one of the brushes 32 indicates a significant difference in power level passing through the brush 32, as indicated by an amperage difference between the like component of other brush holder assemblies 18 being monitored, this may be an indication that a problem exists.

In some instances, a brush 32 having a relatively lower temperature, or a reduced amperage flowing through the brush 32, may indicate for example that the brush 32 is making poor contact with the moving contact surface 40. In some cases, a brush 32 having a relatively higher temperature may be indicative of a threshold and/or anomalous condition of the brush 32 or other component of the brush holder assembly 18, including but not limited to irregular wear, binding, arcing, vibration, burning, etching, or the like. In some cases, a temperature between a portion of the brush 32, such as the brush contact face frictionally contacting the moving conductive surface 40 of the associated brush holder assembly 18 can be compared with the temperature between a portion of a brush of one or more additional brush holder assemblies 18, such as the brush contact face frictionally contacting the moving conductive surface 40, and the temperature difference may be used to determine if a problem exists. Similarly, the temperature difference between the terminals of two or more brush holder assemblies 18 may be used to determine if a problem exists. The degree of temperature difference may indicate a potential threshold and/or anomalous condition of the brush 32 or other component of the brush holder assembly 18.

Those skilled in the art will recognize that the present invention may be manifested in a variety of forms other than the specific embodiments described and contemplated herein. Accordingly, departure in form and detail may be made without departing from the scope and spirit of the present invention as described in the appended claims.

We claim:

1. A brush holder assembly for use in an electrical generator including a moving conductive surface, the brush holder assembly comprising:

a brush holder configured to be removably mounted to a mounting element on the electrical generator;

a carbon brush slidingly disposed with the brush holder, the carbon brush configured to be positioned in contact with the moving conductive surface;

a handle moveable between an unlocked position in which the brush holder is removable from the mounting element and a locked position in which the brush holder is secured relative to the mounting element; and a sensor disposed in the handle that is configured to detect an anomalous or threshold condition of the brush holder assembly.

2. The brush holder assembly of claim 1, wherein the sensor that is configured to detect an anomalous or threshold condition of the brush holder assembly comprises a photo cell that is disposed within a lower surface of the handle, such that the photo cell configured to be aimed at a location on the moving conductive surface adjacent the carbon brush in order to detect arcing between the carbon brush and the moving conductive surface.

3. The brush holder assembly of claim 2, wherein the photo cell is tuned to a light spectrum that is indicative of arcing.

4. The brush holder assembly of claim 1, wherein the sensor comprises a microphone, and the handle includes a circuit board including a controller that is configured to receive an electrical signal from the microphone and listen for sounds indicating arcing between the carbon brush and the moving conductive surface.

5. The brush holder assembly of claim 1, wherein the sensor comprises a laser beam source and a light-sensitive receiver positioned to receive light from the laser beam source that is reflected from a component of the brush holder assembly movable relative to the brush holder.

6. The brush holder assembly of claim 5, wherein the handle includes a circuit board including a controller that is configured to calculate an elapsed time from when the laser beam source provides a light to when the light-sensitive receiver receives the light, and thus determine a distance traveled by the light to provide a measurement of wear of the carbon brush.

7. The brush holder assembly of claim 1, wherein the sensor comprises an ultrasonic transducer and an ultrasonic receiver positioned to receive sound from the ultrasonic transducer that is reflected from a component of the brush holder assembly movable relative to the brush holder.

8. The brush holder assembly of claim 7, wherein the handle includes a circuit board including a controller that is configured to calculate an elapsed time from when the ultrasonic transducer provides a sound to when the ultrasonic receiver receives the sound, and thus determine a distance traveled by the sound to provide a measurement of wear of the carbon brush.

9. The brush holder assembly of claim 1, wherein the sensor comprises a magnetic sensor, and a permanent magnet is secured relative to the carbon brush to follow movement of the carbon brush, the magnetic sensor outputting a signal that is indicative of detected magnetic field strength.

10. The brush holder assembly of claim 9, wherein the handle includes a circuit board including a controller that is configured to determine a distance to the carbon brush, as indicated by the relative position of the permanent magnet to the magnetic sensor, from the outputted signal indicative of detected magnetic field strength.

11. The brush holder assembly of claim 1, further comprising a current meter configured to output a signal indicative of electrical current passing through one or more electrical leads extending from the carbon brush.

12. The brush holder assembly of claim 1, further comprising a temperature sensor configured to output a signal indicative of temperature of one or more electrical leads extending from the carbon brush, the outputted signal indicative of a level of electrical current being collected by the carbon brush and output through the one or more electrical leads extending from the carbon brush.

13. The brush holder assembly of claim 1, further comprising a visual and/or audible indicator disposed on the brush holder assembly and operably coupled to the sensor.

14. The brush holder assembly of claim 13, wherein the visual and/or audible indicator has a first state indicating that no problems have been detected and a second state indicating that a problem has been detected.

15. The brush holder assembly of claim 1, further comprising a circuit board, with the sensor operably coupled to the circuit board.

16. The brush holder assembly of claim 15, further comprising a battery operably coupled to the circuit board in order to power the circuit board.

17. The brush holder assembly of claim 15, further comprising an energy harvesting mechanism configured to draw energy from electricity collected by the carbon brush in order to power the circuit board.

18. The brush holder assembly of claim 17, wherein the energy harvesting mechanism comprises a Hall Effect sensor.

19. The brush holder assembly of claim 15, further comprising a wireless communications module disposed on the circuit board and operably coupled to the sensor.

20. The brush holder assembly of claim 1, wherein the handle comprises a lower portion, an upper portion transverse to the planar lower portion, and an intervening finger ring configured to facilitate movement of the handle.

* * * * *